US006604809B2

(12) United States Patent
Katsuragi et al.

(10) Patent No.: US 6,604,809 B2
(45) Date of Patent: Aug. 12, 2003

(54) CLEANING INK-JET RECORDING HEAD WITH LIQUID COMPOSITION

(75) Inventors: Ryuji Katsuragi, Tokyo (JP); Makoto Shioya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 09/731,835

(22) Filed: Dec. 8, 2000

(65) Prior Publication Data

US 2002/0008725 A1 Jan. 24, 2002

(30) Foreign Application Priority Data

Dec. 14, 1999 (JP) ..... 11-354234

(51) Int. Cl.[7] ..... B41J 2/01; C11D 7/26; C11D 7/36; C11D 17/08

(52) U.S. Cl. ..... 347/28

(58) Field of Search ..... 347/22, 28; 510/108, 510/170

(56) References Cited

U.S. PATENT DOCUMENTS 4,929,964 A 5/1990 Sato et al. ..... 346/1.1
5,062,892 A 11/1991 Halko ..... 106/22
5,825,380 A * 10/1998 Ichizawa et al. ..... 347/28
6,196,657 B1 * 3/2001 Hawkins et al. ..... 347/28

FOREIGN PATENT DOCUMENTS

| | | |
|---|---|---|
| JP | 54-51837 | 4/1979 |
| JP | 2-78554 | 3/1990 |
| JP | 3-160070 | 7/1991 |
| JP | 9-29985 | 2/1997 |

* cited by examiner

*Primary Examiner*—Huan Tran
(74) *Attorney, Agent, or Firm*—Fitzpatrick, Cella, Harper & Scinto

(57) ABSTRACT

A liquid composition for cleaning and removing koga on a heater formed after long-term use of an ink-jet recording head, or contaminants introduced during manufacture of the ink-jet recording head is provided. The liquid composition includes an effective amount of a cleaner to clean an ink-jet recording head, and the cleaner is at least one selected from an organic acid, a salt of organic acid, an organic acid ester, and a salt of organic acid ester.

16 Claims, 7 Drawing Sheets

CLEANING INK-JET RECORDING HEAD WITH LIQUID COMPOSITION

BACKGROUND OF THE INVENTION

1. Field of the Invention

The present invention relates to a liquid composition, a process for cleaning an ink-jet recording head, an ink-jet recorder, a cartridge, and a process for regenerating an ink-jet recording head.

2. Description of the Related Art

Hitherto, a variety of techniques have been proposed as processes for ink-jet recording. Among them, a process for ink-jet recording which includes the step of discharging an ink as ink droplets by action of thermal energy (a so-called bubble-jet recording process) has various advantages. This process is disclosed in, for example, Japanese Patent Laid-Open No. 54-51837. The process can very easily provide high density multi-nozzles, can yield a high quality image at high speed at very low costs, and can even print on sheets of a plain paper without a special coating layer.

In this type of ink-jet recording process, a recorded image is made in the following manner. Specifically, a heater on a recording head is rapidly heated to thereby form a bubble in a liquid on the heater, and the liquid rapidly increases in volume. The rapidly increased volume allows an ink droplet to discharge and fly from a nozzle at the tip of a recording head unit to thereby adhere to a material on which an image is recorded.

When a large quantity of recordings are made according to the above process, the heater on the recording head is heated over and over again to discharge the ink, and decomposed ink, i.e., burnt ink deposits referred to as "koga", are deposited on the heater. Such phenomena, which is called kogation, deposits may sometimes inhibit an effective transmission of thermal energy of the heater to the ink, resulting in that the amount or rate of the ink droplets is decreased as compared with an early stage of recording or that the ink droplets cannot be discharged. To prolong the discharge life of ink droplets of an ink-jet recording head, the deposition of koga must be minimized, and various ink compositions for this purpose have been proposed.

For example, Japanese Patent Laid-Open No. 3-160070 proposes an ink containing an oxo anion. Phosphates, polyphosphates, phosphoric esters, arsenates, molybdates, sulfates, sulfites, and oxalates are listed as the oxo anions. However, the ink is still insufficient to prolong the discharge life, and demands have been made to further prolong ink discharge life of an ink-jet recording head.

In addition to the deposits of koga, a heater surface of an ink-jet recording head immediately after manufacture has sometimes contaminants contaminated during various steps, and ink discharge property becomes unstable from an early stage of recording. To stabilize the initial discharge property, an aging treatment is proposed, as is disclosed in, for example, Japanese Patent Laid-Open No. 2-78554. However, such an aging treatment may sometimes induce adherence of koga on the heater surface. In this case, the ink discharge is decreased from early stage of recording, and the original or inherent discharge property cannot be exhibited.

As a possible solution to the above problems, Japanese Patent Laid-Open No. 9-29985 proposes a process for cleaning an ink-jet recording head by use of an aqueous solution containing an electrolyte.

After various investigations, the present inventors found that the aforementioned technique described in the Japanese Patent Laid-Open No. 9-29985 can effectively clean an ink-jet recording head. However, as this process cleans the head using an aqueous strong electrolyte solution containing an inorganic ion, the heater is liable to be damaged and must be very carefully handled. To further prolong the life of an ink-jet recording head, the present inventors had a perception of a novel technique that can remove koga formed on the surface of a heater of an ink-jet recording head in a more safe manner or can clean the surface of the heater, while minimizing damage to the heater.

SUMMARY OF THE INVENTION

Accordingly, it is an object of the present invention to provide a liquid composition which can clean and remove koga formed in a long-term use of an ink-jet recording head or contaminants contaminated during the manufacture of the ink-jet recording head and which exerts no or minimized influence upon the ink-jet recording head, to thereby prolong the life of the ink-jet recording head.

It is another object of the present invention to provide a process for cleaning an ink-jet recording head, which process can remove koga or contaminants on the surface of an ink-jet recording head while minimizing the influence upon a heater of the recording head.

A further object of the present invention is to provide an ink-jet recording apparatus which can remove koga or contaminants on the surface of an ink-jet recording head while minimizing the influence upon a heater of the recording head, as well as a cartridge for use in the ink-jet recording apparatus.

Yet another object of the present invention is to provide a process for regenerating an ink-jet recording head by cleaning or removing koga or contaminants adhered on a heater of the ink-jet recording head.

Specifically, the present invention provides, in an aspect, a liquid composition including at least one cleaning agent in an effective amount to clean an ink-jet recording head. The cleaning agent is at least one selected from organic acids, salts of organic acids, organic acid esters, and salts of organic acid esters.

In another aspect, the present invention provides a liquid composition for use in removal of adherents on a surface of an ink-jet recording head, the recording head includes a heater and discharges an ink containing a coloring material by action of the heater, and a surface of the heater is covered with an outermost protective layer including at least one of a metal and a metallic oxide. The liquid composition oxidatively decomposes adherents on a surface of the ink-jet recording head by applying energy to the heater in a stage where the heater is in contact with the liquid composition.

In a further aspect, the present invention provides a process for cleaning an ink-jet recording head. This process includes the use of, for example, the aforementioned liquid composition.

The present invention provides, in yet another aspect, a process for cleaning an ink-jet recording head, which ink-jet recording head has a heater, and a surface of the heater is covered with a protective layer including at least one either of a metal and a metallic oxide. This process includes the step of applying energy to the heater in a state where the heater is in contact with the liquid composition.

In another aspect, the present invention provides an ink-jet recording apparatus. The ink-jet recording apparatus includes, for example, a liquid tank filled with the aforementioned liquid composition, an ink tank filled with an ink containing a coloring material, an ink-jet recording head for discharging the ink, a device for supplying the liquid composition and the ink respectively from the liquid tank and the ink tank to the ink-jet recording head, and a valve device for optionally selecting between the supply of the liquid composition and the supply of the ink to the recording head.

In a further aspect, the present invention provides a cartridge for use in cleaning of an ink-jet recording head, which ink-jet recording head has a heater, a surface of the heater is covered with a protective film including at least one of a metal and a metallic oxide. This cartridge is detachably configured with respect to the ink-jet recording head and preserves the liquid composition.

In addition and advantageously, the present invention provides a process for regenerating an ink-jet recording head, which ink-jet recording head has a heater and serves to discharge ink containing a coloring material, the heater is covered with an outermost protective layer on its surface, and the outermost protective layer includes at least one of a metal and a metallic oxide. This process includes the step of applying thermal energy to the heater in a state where the surface of the heater is in contact with the liquid composition.

Further objects, features, and advantages of the present invention will become apparent from the following description of the preferred embodiments with reference to the attached drawings.

DESCRIPTION OF THE PREFERRED EMBODIMENTS

Figure 1:
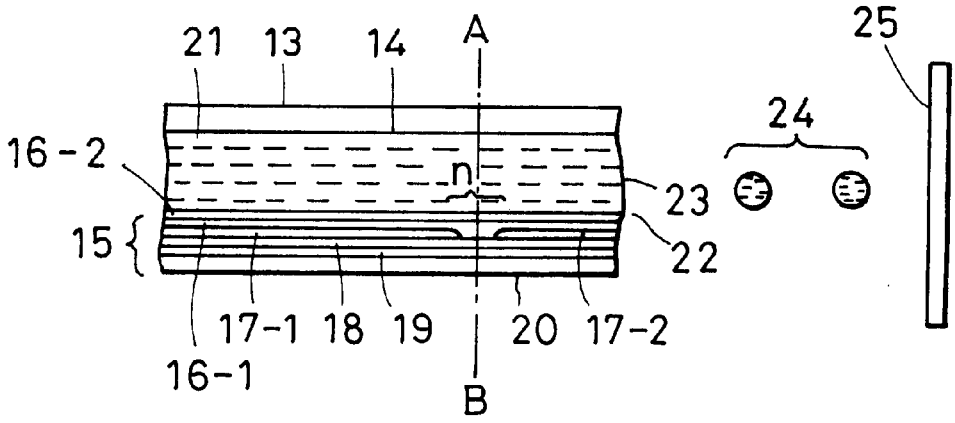
FIG. 1 is a longitudinal sectional view showing an embodiment of a recording head of an ink-jet recording apparatus according to the present invention.

The present invention will be illustrated in further detail with reference to preferred embodiments.

Initially, a liquid composition according to the present invention preferably comprises, for example, an organic acid as a cleaning agent in an effective amount to clean an ink-jet recording head. The reasons why such organic acids can clean and remove koga and/or contaminants on the surface of a heater are not sufficiently clear. However, it is probably because the organic acids are allowed to foam on the heater surface of the ink-jet recording head to thereby clean and remove koga and contaminants adhered onto the heater surface, through oxidative decomposition or by action of impact of foaming and defoaming. Thus, the heater can be regenerated to an initial condition, and the ink discharge property which has once become unstable due to kogation or contaminants adhered on the heater surface can be stabilized again.

According to the aforementioned technique described in Japanese Patent Laid-Open No. 9-29985, koga is removed by action of an electrochemical reaction on a heater surface using an aqueous solution containing a strong electrolyte. However, the liquid composition containing an organic acid exhibits only little ionization and does not induce an electrochemical reaction on the heater surface.

Such organic acids for use in the liquid composition as a cleaning agent for a heater of an ink-jet recording head include, but are not limited to, organic acids, salts of organic acids, organic acid esters, and salts of organic acid esters. Preferred salts of these substances are lithium salts, sodium salts, and potassium salts.

The organic acids include, for example, carboxylic acids, sulfonic acids, and phenols. Among them, carboxylic acids or salts thereof are preferred, of which carboxylic acids each having a hydroxyl group or salts thereof are typically preferred.

Such carboxylic acids include, but are not limited to, formic acid, acetic acid, propionic acid, butyric acid, valeric acid, benzoic acid, and other monocarboxylic acids; oxalic acid, malonic acid, succinic acid, glutaric acid, adipic acid, maleic acid, fumaric acid, phthalic acid, isophthalic acid, terephthalic acid, and other dicarboxylic acids; and ethylenediaminetetraacetic acid, and other polycarboxylic acids.

The sulfonic acids include, for example, ethanesulfonic acid. The phenols include, but are not limited to, phenol, 4-phenolsulfonic acid, 1-naphthol, 2-naphthol, 1-naphthol-4-sulfonic acid, and 2-naphthol-6-sulfonic acid. The carboxylic acids each having a hydroxyl group include, for example, lactic acid, malic acid, and citric acid.

The organic acid esters include, for example, polyol phosphoric esters such as phosphoric esters of polyols, monosaccharides, oligosaccharides, and polysaccharides. Such polyol phosphoric esters include, but are not limited to, α-glycerophosphoric acid, β-glycerophosphoric acid, glucose 1-phosphate, glucose 6-phosphate, mannose 6-phosphate, galactose 6-phosphate, fructose 6-phosphate, glucose 1,6-diphosphate, fructose 1,6-diphosphate, ascorbic phosphate sucrose phosphate, sorbitol phosphate, polyglycerol phosphate, and polyethylene glycol phosphate. Among them, α-glycerophosphoric acid and β-glycerophosphoric acid are preferred.

Typically preferred organic acids for use in the invented liquid composition include, for example, aldonic acids, γ-aldonic lactones, δ-aldonic lactones, salts of aldonic acids, aldaric acids, and salts of aldaric acids. Initially, the aldonic acids, γ-aldonic lactones, δ-aldonic lactones, and salts of aldonic acids will be described. An aldonic acid is a polyoxycarboxylic acid corresponding to an aldose in which its aldehyde group is oxidized into a carboxylic group, and is represented by the following formula:

$$HOCH_2(C^*HOH)_nCOOH$$

wherein n denotes an integer of 0 or more, and C* represents an asymmetric carbon atom. The aldonic acid has the asymmetric carbon atom represented by C* and there are a variety of optical isomers.

An aldonic acid having five or more carbon atoms (i.e., n is 3 or more in the above formula) is rarely in existence alone in an aqueous solution. The aldonic acid having five or more carbon atoms is believed to partially form a lactone ring with a hydroxyl group at γ-position or δ-position to thereby form a γ-aldonic lactone and a δ-aldonic lactone, and to reside as an equilibrium mixture of the aldonic acid, γ-aldonic lactone, and δ-aldonic lactone. An aldonic acid having four carbon atom (i.e., n is 2 in the above formula) is also rarely in existence alone in an aqueous solution. The aldonic acid having four carbon atoms is believed to partially form a lactone ring with a hydroxyl group at γ-position to thereby form a γ-aldonic lactone and to reside as an equilibrium mixture of the aldonic acid and γ-aldonic lactone.

Such aldonic acids are classified by the number of carbon atoms, and are generically called tetronic acids when the aldonic acids each have four carbon atoms (n is 2 in the formula); pentonic acids when the aldonic acids each have five carbon atoms (n is 3 in the formula); and hexonic acids when the aldonic acids each have six carbon atoms (n is 4 in the formula). Examples of aldonic acids include, but are not limited to, those each having two carbon atoms (n is 0 in the formula) such as glycolic acid; those each having three carbon atoms (n is 1 in the formula) such as glyceric acid; those each having four carbon atoms (n is 2 in the formula) such as erythronic acid and threonic acid; those each having five carbon atoms (n is 3 in the formula) such as ribonic acid, arabonic acid, xylonic acid, and lyxonic acid; those each having six carbon atoms (n is 4 in the formula) such as gluconic acid, allonic acid, altronic acid, mannonic acid, gulonic acid, idonic acid, galactonic acid, and talonic acid; and those each having seven carbon atoms (n is 7 in the formula) such as glucoheptonic acid. There are a D-form, an L-form, and a DL-form in some of these aldonic acids.

A typically preferred aldonic acid is gluconic acid having six carbon atoms. Gluconic acid is rarely in existence alone in an aqueous solution. It is believed that gluconic acid generally partially forms a lactone ring with a hydroxyl group at γ-position or δ-position, to thereby form γ-gluconic lactone or δ-gluconic lactone, respectively and that it is in existence as an equilibrium mixture of gluconic acid, γ-gluconic lactone, and δ-gluconic lactone. There are D-gluconic acid, L-gluconic acid, and DL-gluconic acid, and any of these forms can be employed. In general, D-form D-gluconic acid is easily available. In addition, optical isomers of gluconic acid have similar characteristics to those of gluconic acid and can therefore be advantageously employed. Such optical isomers of gluconic acid include, for example, allonic acid, altronic acid, mannonic acid, gulonic acid, idonic acid, galactonic acid, and talonic acid.

Gluconic salts include, but are not limited to, lithium gluconate, sodium gluconate, potassium gluconate, magnesium gluconate, calcium gluconate, barium gluconate, iron (II) gluconate, and copper(II) gluconate. Among them, lithium gluconate, sodium gluconate, and potassium gluconate are preferred. Each of these gluconic acid and gluconic salts can be used alone or in combination.

Next, the aldaric acid and salts of aldaric acids will be described. An aldaric acid is a polyoxydicarboxylic acid corresponding to an aldose in which its aldehyde group and primary alcohol group are oxidized into carboxyl groups, and is represented by the following formula:

$$HOOC(C^*HOH)_nCOOH$$

wherein n denotes an integer of 1 or more, and C* represents an asymmetric carbon atom. Such an aldaric acid has the asymmetric carbon atom represented by C* and there are a multitude of optical isomers. An aldaric acid having five or more carbon atoms (n is 3 or more in the formula) more or less induces intramolecular dehydration to form mono- and di-lactone rings. Such a monolactone is also called as a lactonic acid and includes two types of laconic acids, i.e., one formed with one carboxyl group and one formed with the other carboxyl group, depending on conditions.

The aldaric acids are classified by the number of carbon atoms, and are generically called as triaric acids when they have three carbon atoms (n is 1 in the formula); tetraric acids when they have four carbon atoms (n is 2 in the formula); pentaric acids when they have five carbon atoms (n is 3 in the formula); and hexaric acids when they have six carbon atoms (n is 4 in the formula). Examples of aldaric acids include, but are not limited to, those each having three carbon atoms (n is 1 in the formula) such as tartronic acid; those each having four carbon atoms (n is 2 in the formula) such as tartaric acid; those each having five carbon atoms (n is 3 in the formula) such as xylosaccharic acid, ribosaccharic acid, and arabosaccharic acid; and those each having six carbon atoms (n is 4 in the formula) such as glucosaccharic acid, mannosaccharic acid, idosaccharic acid, mucic acid, talomucic acid, and allomucic acid. There are D-form, L-form, meso-form and DL-form in some aldaric acids.

Of these aldaric acids, typically preferred is tartaric acid. There are D-form, L-form, DL-form and meso-form in tartaric acid, and any of these forms can be employed. In general, the L-form, L-tartaric acid is easily available. Salts of tartaric acid include, but are not limited to, lithium tartrate, sodium tartrate, potassium tartrate, magnesium tartrate, calcium tartrate, barium tartrate, iron(II) tartrate, copper(II) tartrate, and ammonium tartrate. Among them, lithium tartrate, sodium tartrate, potassium tartrate, and sodium potassium tartrate are preferred. Each of these tartaric acid and salts thereof can be used alone or in combination.

The amount of the cleaner is preferably about 0.05 to 40% by weight, and more preferably about 0.3 to 10% by weight based on the total weight of the liquid composition.

As water to be incorporated into the invented liquid composition, deionized water is more preferred than a general water containing various ions. The content of the water is preferably about 60 to 99.95% by weight based on the total weight of the liquid composition.

The invented liquid composition has only to contain an oxidizing compound as mentioned above and water. In addition to these components, the liquid composition may further comprise a water-soluble organic solvent in order to control the viscosity or surface tension of the liquid composition to appropriate viscosity or surface tension in practical use and to ensure the liquid composition to stably foam.

Such water-soluble organic solvents include, but are not limited to, methanol, ethanol, n-propyl alcohol, isopropyl alcohol, n-butyl alcohol, sec-butyl alcohol, tert-butyl alcohol, isobutyl alcohol, n-pentanol, and other. saturated alcohols each having 1 to 5 carbon atoms; dimethylformamide, dimethylacetamide, and other amides; acetone, diacetone alcohol, and other ketones or keto-alcohols; tetrahydrofuran, dioxane, and other ethers; diethylene glycol, triethylene glycol, tetraethylene glycol, dipropylene glycol, tripropylene glycol, polyethylene glycol, polypropylene glycol, and other oxyethylene or oxypropylene (co-) polymers; ethylene glycol, propylene glycol, trimethylene glycol, triethylene glycol, 1,2,6-hexanetriol, and other polyols whose alkylene group has 2 to 6 carbon atoms; glycerin; trimethylolethane, trimethylolpropane; ethylene glycol monomethyl (or monoethyl) ether, diethylene glycol monomethyl (or monoethyl) ether, and other lower alkyl ethers; triethylene glycol dimethyl (or diethyl) ether, tetraethylene glycol dimethyl (or diethyl) ether, and other lower alkyl ethers of polyhydric alcohols; monoethanolamine, diethanolamine, triethanolamine, and other alkanolamines; sulfolane, N-methyl-2-pyrrolidone, 2-pyrrolidone, and 1,3-dimethyl-2-imidazolidinone. Each of these water-soluble organic solvents can be used alone or in combination.

The liquid composition may further comprise an agent for pH adjustment to stabilize the solubility of the cleaner. Such agents for pH adjustment include, but are not limited to, lithium hydroxide, sodium hydroxide, potassium hydroxide, ammonium hydroxide, and other hydroxides; sulfuric acid, hydrochloric acid, and other acids; lithium sulfate, sodium sulfate, potassium sulfate, ammonium sulfate, and other sulfates; lithium carbonate, sodium carbonate, sodium hydrogencarbonate, potassium carbonate, potassium hydrogencarbonate, potassium sodium carbonate, ammonium carbonate, ammonium hydrogencarbonate, and other carbonates; lithium phosphate, monosodium phosphate, disodium phosphate, trisodium phosphate, monopotassium phosphate, dipotassium phosphate, tripotassium phosphate, monoammonium phosphate, diammonium phosphate, triammonium phosphate, and other phosphates.

In addition to these components, the invented liquid composition may further comprise conventionally known various additives according to necessity. Such additives include, for example, viscosity modifiers, fungicides, antiseptic agents, antioxidants, antifoaming agents, surfactants, and moisturizers such as urea.

The ink-jet recording head to be cleaned by the liquid composition is preferably a recording head for use in a bubble-jet recording technique, that is, an ink-jet recording technique in which thermal energy corresponding to a recording signal is applied to an ink in a chamber in a recording head, and the thermal energy allows the ink to form ink droplets. A recording apparatus using this type of recording technique will be described below with reference to the attached drawings.

Figure 2:
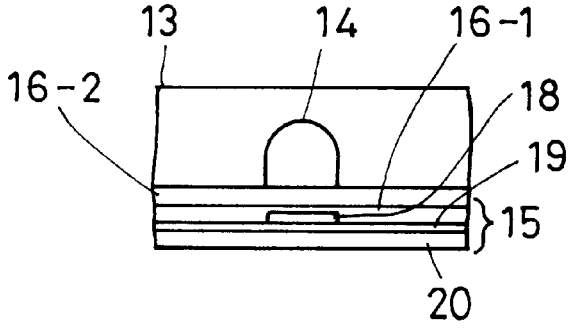
FIG. 2 is a cross sectional view sowing an embodiment of a recording head of the invented ink-jet recorder.

Initially, FIGS. 1 and 2 show an example of the configuration of a recording head which constitutes an important part of an ink-jet recording apparatus using thermal energy (a so-called bubble-jet recording apparatus). FIG. 1 is a sectional view of recording head 13 taken along an ink passage, and FIG. 2 is a cross sectional view of the recording head taken along the line A-B in FIG. 1. Recording head 13 includes heater element base 15 adhered to a material with passage (nozzle) 14 for passing the ink. Such materials include boards or plates of glass, ceramics, silicon, polysulfone, or plastics.

Heater element base 15 comprises a protective layer 16-1, outermost protective layer 16-2, electrodes 17-1 and 17-2, heat resistor layer 18, regenerator layer 19, and base 20. Protective layer 16-1 is made of, for example, silicon oxide, silicon nitride, or silicon carbide. Outermost protective layer 16-2 is made of, for example, platinum and other metals, or platinum oxide and other metal oxides, and preferably made of tantalum or tantalum oxide. Electrodes 17-1 and 17-2 are made of, for example, aluminium, gold, or an aluminium-copper alloy. Heat resistor layer 18 is made of, for example, hafnium boride, tantalum nitride, tantalum aluminium, and other high melting (refractory) materials. Regenerator layer 19 is made of, for example, silicon oxide or aluminium oxide. Base 20 is made of, for example, silicon, aluminium, aluminium nitride, and other radiating materials.

Figure 3:
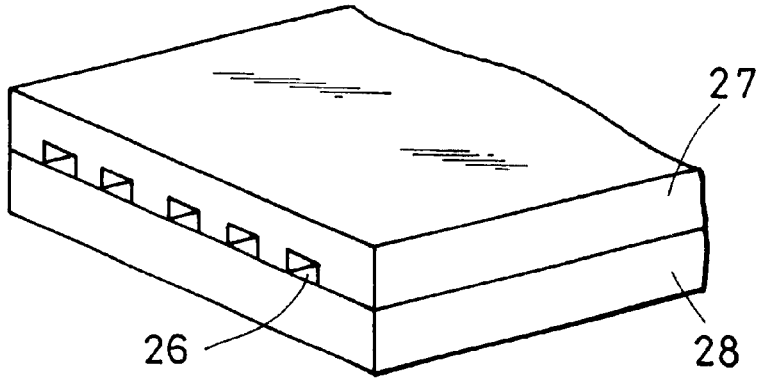
FIG. 3 is a perspective outside view of a head which is an assembly of a multitude of the recording heads shown in FIG. 1.

When an electric pulse signal is applied onto electrodes 17-1 and 17-2 of recording head 13, a region represented by "n" (heater) in heater element base 15 rapidly produces heat, to thereby form bubbles in ink 21 in contact with the surface of the heater, and meniscus 23 protrudes by action of a pressure from the bubbles, ink 21 is discharged through nozzle 14 of recording head 13 and is converted into ink droplets 24 through discharge orifice 22, and flies toward material 25 to be recorded. FIG. 3 is an outside view of an example of a multi-head recording apparatus which is an array of a multitude of the recording head shown in FIG. 1. The multi-head includes glass plate 26 having multi-nozzle 26 adhered to heating head 28 similar to that described in FIG. 1.

Figure 4:
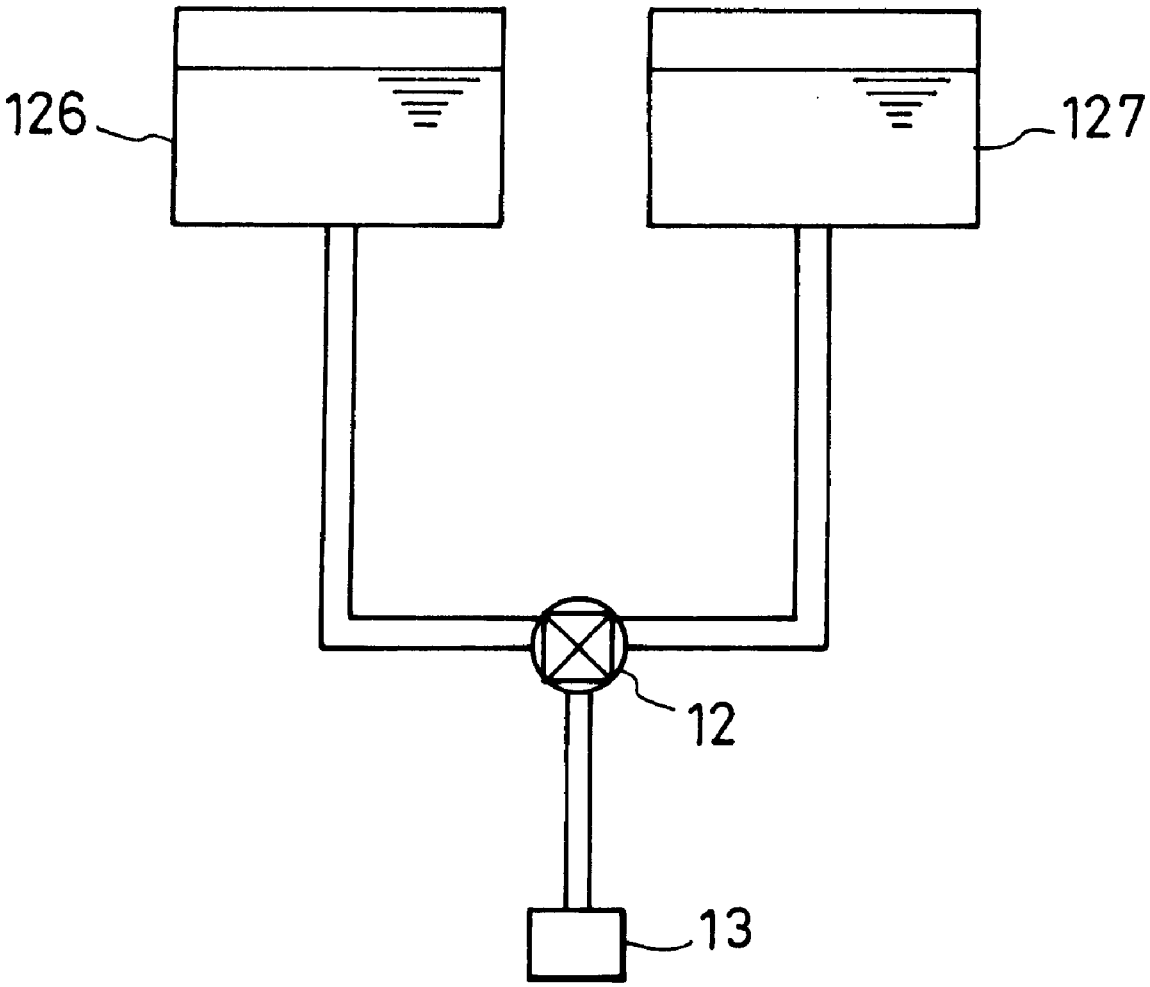
FIG. 4 is a schematic diagram showing the passages of an ink and a liquid composition in the invented ink-jet recording apparatus.

Next, the invented ink-jet recording apparatus will be described. FIG. 4 is a schematic diagram showing passages of the ink and the invented liquid composition in the invented ink-jet recording apparatus. Ink tank 126 or tank 127 reserving the liquid composition is optionally selected through switching valve 12 to thereby supply the ink or the liquid composition to recording head 13.

In case of printing, the ink is supplied from ink tank 126 to recording head 13. When kogation occurs on a heater of recording head 13 as a result of, for example, large quantity of printing, and the amount of discharge is decreased or discharge of the ink becomes unstable, valve 12 is switched to supply the liquid composition from liquid composition tank 127 to recording head 13 to thereby clean the heater of recording head 13. Separately, the heater surface of recording head 13 immediately after manufacture sometimes has contaminants introduced during various steps, and the ink discharge property becomes unstable. In this case, the liquid composition can be supplied to recording head 13 to clean the heater of recording head 13 to thereby stabilize initial discharge property.

To clean the heater, about $1\times10^2$ to $1\times10^7$ shots (droplets), and preferably about $1\times10^3$ to $5\times10^6$ shots of the liquid composition may be discharged from the recording head. After the cleaning of the heater, the ink is again supplied to recording head 13 to do printing. Thereafter, the heater may be cleaned according to the above procedure every time the discharge becomes unstable.

More practically, the heater can be cleaned by the following processes: a process in which a user cleans the heater on a certain time basis or on a basis of a certain number of sheets of recording paper recorded, a process in which a special switch or sequence to remove kogation is provided in a printer (recording apparatus) itself, and the user sets the operation of this switch or sequence, and a process in which the printer itself automatically distinguishes the liquid composition cartridge to initiate the operation.

Figure 5:
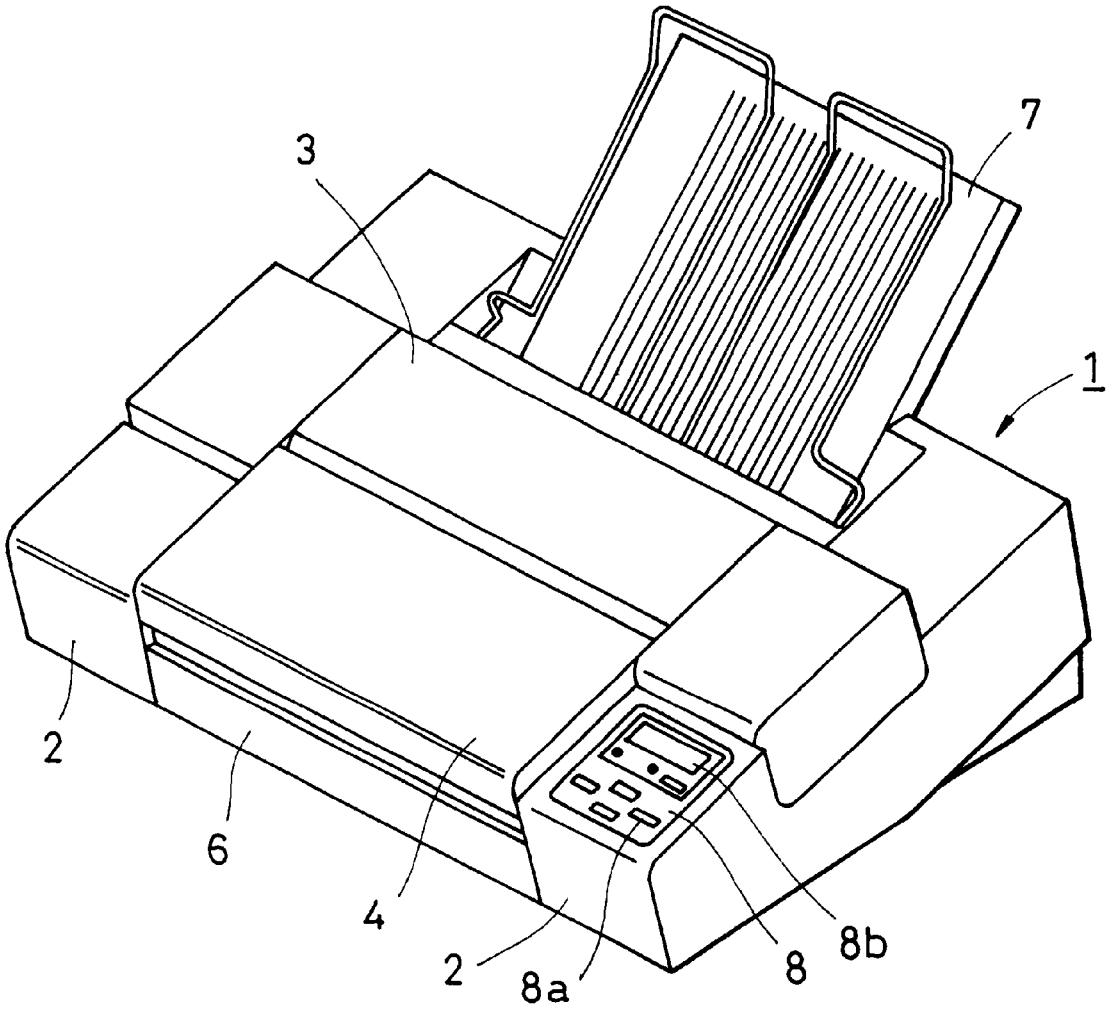
FIG. 5 is a perspective outside view of an ink-jet recording apparatus according to an embodiment of the present invention.
Figure 6:
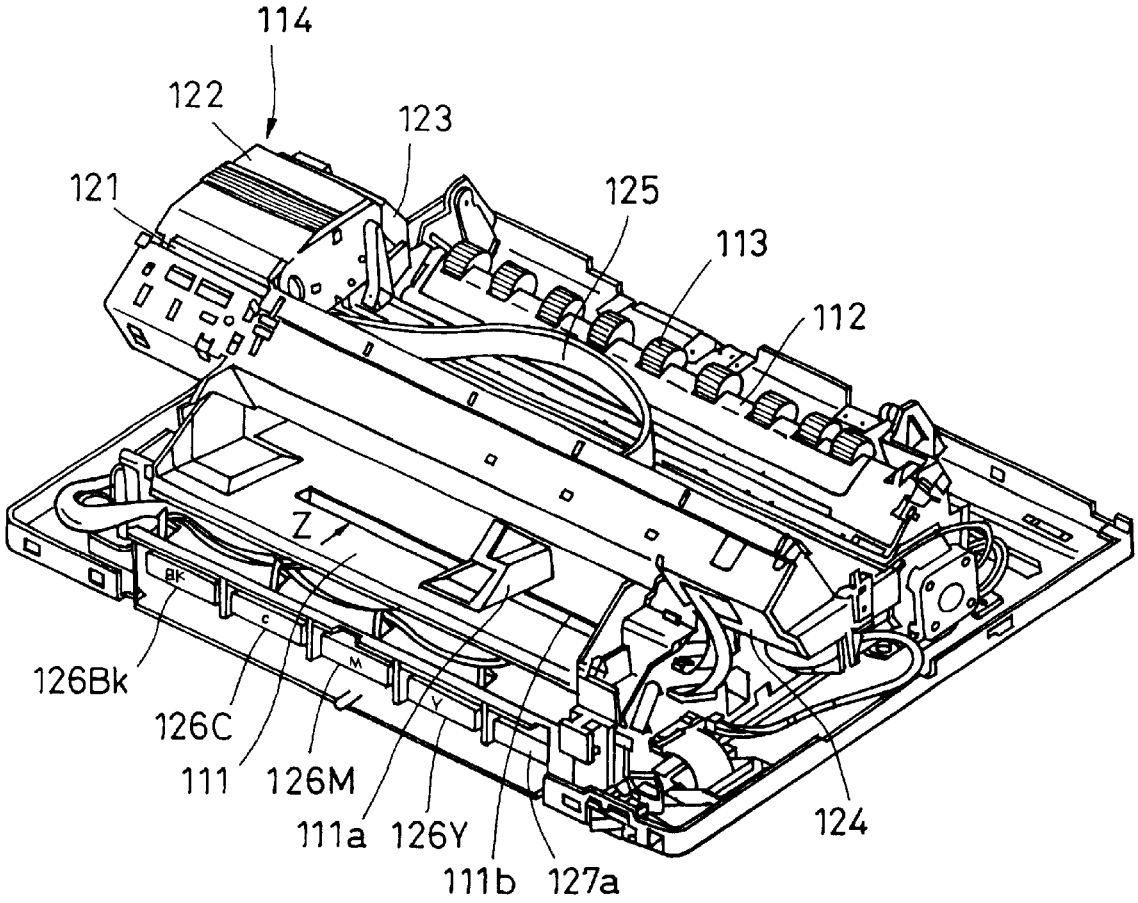
FIG. 6 is a perspective view showing an inside configuration of the ink-jet recording apparatus of Figures.
Figure 7:
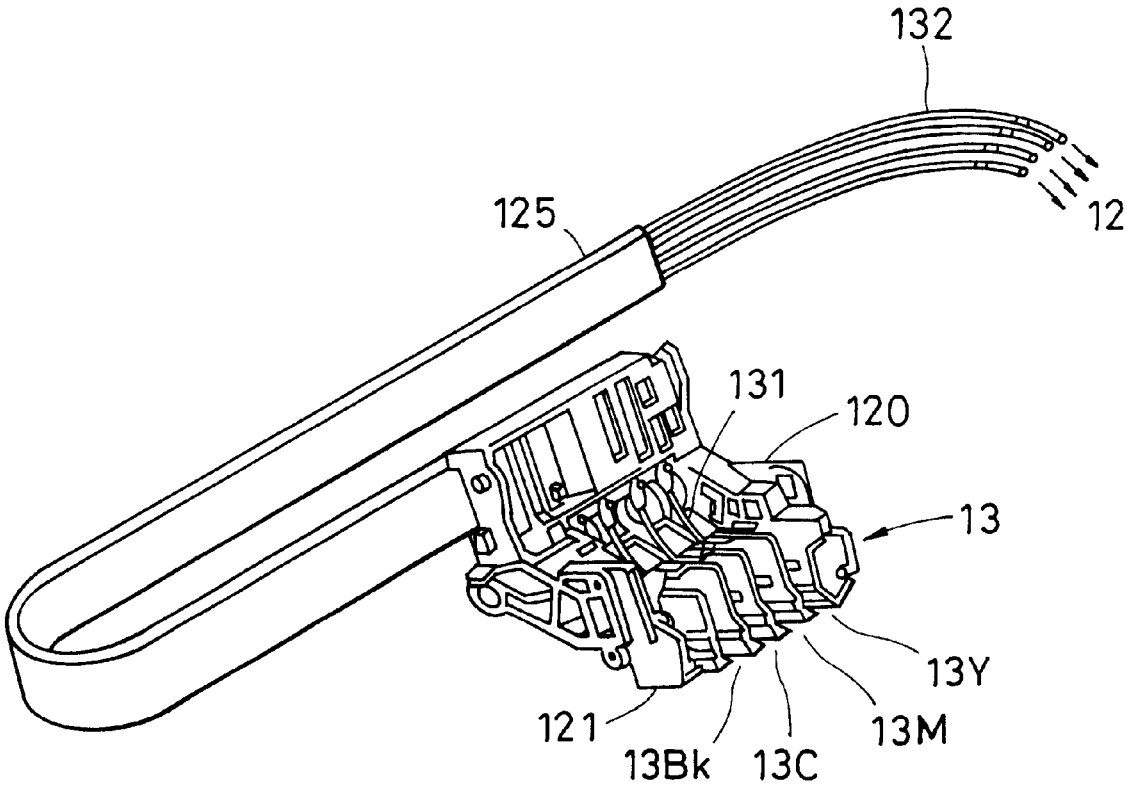
FIG. 7 is a perspective view showing the configuration of a recording head carriage and a tube unit of the ink-jet recording apparatus of FIGS. 5 and 6.
Figure 8:
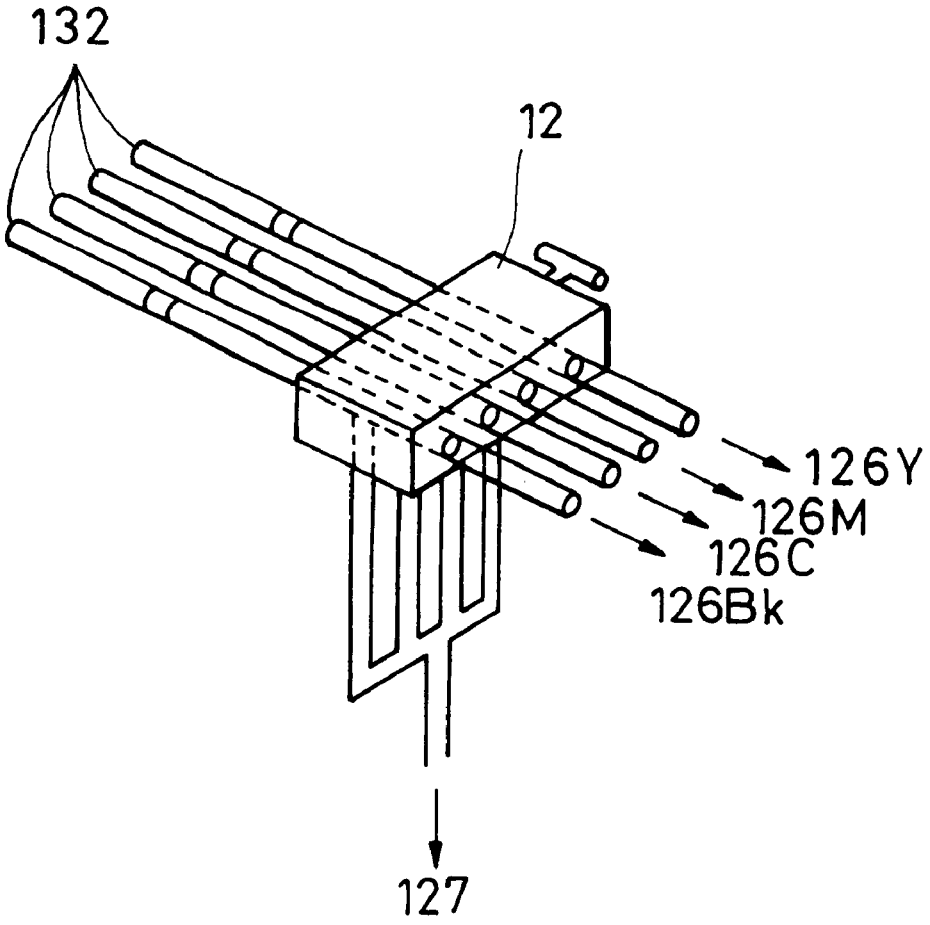
FIG. 8 is a perspective outside view showing how a tube member is engaged with a switching valve member in the ink-jet recording apparatus of FIGS. 5, 6 and, 7.
Figure 9:
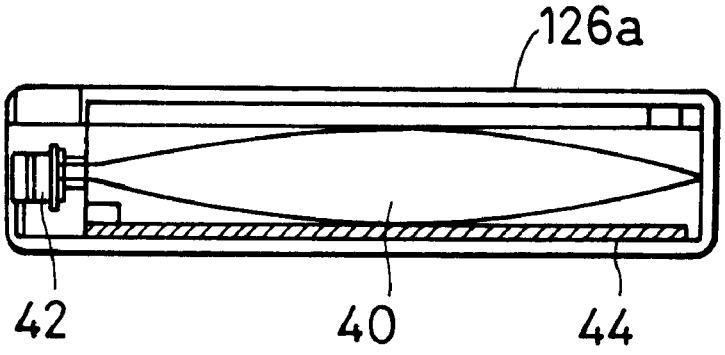
FIG. 9 is a perspective view showing an example of the inside configuration of an ink cartridge according to the ink-jet recording apparatus of FIGS. 5 and 6.

FIG. 5 is a perspective outside view of an ink-jet recording apparatus according to an embodiment of the present invention; FIG. 6 is a perspective view showing an inside configuration of the ink-jet recording apparatus of this embodiment; FIG. 7 is a perspective view showing a recording head carriage and a tube unit of the ink-jet recording apparatus of the embodiment; FIG. 8 is a perspective outside view showing how a tube member is engaged with a switching valve member in the embodiment; and FIG. 9 is a perspective view showing the inside configuration of an ink cartridge according to the embodiment.

In FIG. 5, ink-jet recording apparatus 1 (hereinafter referred to as "recording apparatus") includes main casing 2 which constitutes part of a casing (hereinafter referred to as "casing") of the recording apparatus 1. Main casing 2 covers both ends of recording apparatus 1 fixed to part of a below-described frame of the recording apparatus 1. Specifically, main casing 2 covers portions of recording apparatus 1 other than portions corresponding to the width of a transporting passage in which the recording paper is transported.

Of the both ends, a home position of the recording head is specified at one end, and main casing 2 covers the recording head which positions at this position when recording is not performed and covers a discharge recovery unit. The discharge recovery unit caps an ink discharge surface of the recording head at this position. When part of the casing is opened and the maintenance and checkout of the recording apparatus is performed, the recording head or the discharge recovery unit may be accidentally touched, and these units may be misaligned or be damaged. The above configuration can prevent such misalignment or damage.

Center casing 3 also constitutes part of the casing and mainly covers an area where recording head 13 is transported upon recording. Center casing 3 is provided so as to easily be mounted and dismounted. Part of center casing 3 includes spurs corresponding to an ejecting roller mentioned below, and the spurs are pressed at an appropriate thrust to the ejecting roller.

Feeding lid 4 constitutes part of the casing and is reclosably provided. Feeding lid 4 has a nearly rectangular shape, wherein both ends of feeding lid 4 on the frontward side in the figure are pivoted. Feeding lid 4 can be opened upward in the figure using the pivoted portions as a rotary axis and can be held at a predetermined angle. When feeding lid 4 is held at the angle, it positions nearly in line with a feeding tray mentioned below, and sheets of the recording paper can be placed thereon.

Ink lid 6 constitutes part of the casing on the frontward side of the recording apparatus. Ink lid 6 is rotatably pivoted by an axis provided at the lower side frontward of the recording apparatus, and can be opened frontward of ink lid 6 according to necessity. By this configuration, mounting and dismounting of an ink cartridge housed inside and other mounting and dismounting operations can be performed.

Ejecting tray 7 is detachably mounted with respect to recording apparatus 1. Ejecting tray 7 is mounted in the rear of recording apparatus 1 at a predetermined angle and can serve to stack sheets of recorded recording paper in turn. Control unit 8 is arranged on the one side of main casing 2 in the front of recording apparatus 1. Control unit 8 includes display unit 8*b* displaying, for example, the status of recording apparatus 1, and key 8*a* for entering various commands to recording apparatus 1.

In FIG. 6, feeding tray 111 constitutes a feeding unit together with feeding lid 4 shown in FIG. 5 (not shown in FIG. 6) when it is opened. The recording paper is placed on feeding tray 111 and is transported in the direction Z indicated by the arrow in the figure through a feeding roller (not shown). In the feeding mechanism, guide plate 111*a* serves to guide fed paper according to the size of the recording paper. Channel 111*b* serves to allow guide plate 111*a* to move according to the size of the recording paper. The term "recording paper" as used herein widely means recording media and also includes plastic sheets and other recording media.

Platen 112 serves to regulate a recording surface of the recording paper and is placed on the passage of the recording paper downstream from the transporting roller and other units facing recording head 13 mentioned below. In addition, ejecting roller 113 is arranged slipstream from platen 112. Ejecting roller 113 is rotated through a motor (not shown) to thereby eject recording paper to ejecting tray 7 shown in FIG. 5 in cooperation with the spurs held by center casing 3 shown in FIG. 5.

Recording head unit 114 includes four recording head tips corresponding to individual ink colors, described in detail in FIG. 7. These head tips are mounted onto carriage body 121 of carriage unit 120 in such a manner as to be easily mounted and dismounted. Carriage unit 120 also includes carriage cover 122 and head cover 123. The mounting of these covers onto carriage body 121 can establish electrical connection with the recording head tips, and define registration and fixing of the tips. An auxiliary ink tank (not shown) is arranged in part of carriage body 121 and serves to collect bubbles in an ink supply system and to cushion variation in pressure which occurs with the transportation of the carriage. By this configuration, recording head 13 is protected from influences from the bubbles and variation in pressure.

Cover 124 is fixed on the recorder frame and serves to protect ink supply tube unit 125, a flexible cable (not shown) and other units which follow the movement of carriage unit 120. Each of ink cartridges 126Bk, 126C, 126M, and 126Y is mounted inside the ink supply unit and houses an ink pouch and a wasted-ink pouch. The ink pouches carry black (Bk), cyan (C), magenta (M), and yellow (Y) inks respectively. The wasted-ink pouches absorb wasted ink exhausted, for example, through ink suction procedure in a discharge recovery treatment. Liquid composition cartridge (liquid composition tank) 127 is mounted inside the ink supply unit and houses a reserving pouch for the liquid composition and a wasted-liquid composition pouch for aspirating the liquid composition exhausted, for example, in suction in the discharge recovery treatment.

FIG. 7 shows the recording head tips corresponding to four color inks in a state where carriage cover 122 and head cover 123 are dismounted. When the recording head tips are mounted, they are precisely positioned on predetermined positions (shown by 13Bk, 13C, 13M, and 13Y in the figure corresponding to individual colors) of cartridge body 121 to thereby establish electric connection for transmitting signals to the recording head and to supply the ink.

Tube member (hereinafter referred to as "tube") 131 serves to supply the ink between recording head 13 and auxiliary tank, and tube 132 serves to supply ink between the auxiliary tank and the ink cartridge. The tubes may be preferably made of a polyethylene resin. When these tubes are configured as thin-walled tubes, they are translucent and at which level the inside ink is filled can be visually observed.

FIG. 8 is a perspective outside view showing an engagement part between the tube member and the switching valve member in the above embodiment. To switch between the ink and the liquid composition, switching valve 12 is used. Preferably and advantageously, a valve mechanism is arranged between the auxiliary tank in recording head 13 and a chamber of recording head 13, which chamber is used in common for the ink and the liquid composition (hereinafter referred to as "common chamber"). This configuration is preferred for the following reason.

Such an auxiliary tank is designed to have a capacity of 3 to 10 mL of ink. In contrast, the common chamber of the recording head has a capacity of reserving 0.3 to 0.5 mL of ink. When the ink in the auxiliary tank in addition to the common chamber is also replaced with the liquid composition, the amount of wasted ink is considerably larger than that in the case when the ink in the common chamber alone is replaced with the liquid composition. Accordingly, it is advantageous to supply the liquid composition not to the auxiliary tank but to the chamber of recording head 13, from viewpoints of the amount of wasted ink and required times to waste and recharge the ink. Specifically, the above configuration can be achieved by arranging a two-way valve between the auxiliary tank and the common chamber or by arranging a switching valve and a check valve in combination.

When the two-way valve is employed, a passage in which the ink usually flows is provided, and when the liquid composition is required, the liquid composition is supplied only to the common chamber of the recording head by switching the two-way valve. By this configuration where the two-way valve is employed, the liquid composition is not supplied to the auxiliary tank and is therefore not mixed with the ink in the auxiliary tank, which eliminates the need for exhausting and replacing the ink in the auxiliary tank.

To employ the check valve and switching valve, a polyethylene thin film may be thermally melted and deposited as a check valve in the ink passage while part of the film is not melted and deposited. This configuration allows the ink to flow in only one direction and inhibits the same from flowing in the other direction (opposite direction). Subsequently, a pipe to supply the liquid composition is connected to, for example, the side of the passage on the recording head chamber side downstream from the position where the check valve is arranged. Directly adjacent to the pipe, a switching valve is arranged, and the liquid composition is supplied by opening or closing the switching valve.

Thus, when the switching valve is opened and the liquid composition is supplied at a pressure about 0.3 atm higher than that at which the ink is usually supplied, the liquid composition flows not toward the auxiliary tank but toward the chamber of recording head 13, by action of the check valve. By this procedure, the ink in the chamber is squeezed out from the chamber by action of the pressure of the liquid composition, and the inside of the common chamber of recording head 13 is replaced with the liquid composition. At the time when the supply of a predetermined volume of the liquid composition is completed, the switching valve is closed, and a predetermined cleaning operation may be performed in this state. Subsequently, the ink is supplied and replaced with the liquid composition by an aspiration and restoration means or by pressurized supply of the ink.

FIG. 9 is a diagram of an example of the inside configuration of ink cartridge 126*a* housing an ink. The ink is supplied via a tube to recording head 13 according to the above embodiment. Ink holder 40 such as an ink pouch houses an ink to be supplied, and includes rubber plug 42 at its end. By inserting a needle (not shown) into plug 42, the ink in ink pouch 40 can be supplied to recording head 13. Ink absorber 44 receives wasted ink. The surface in contact with the ink of the ink holder should be preferably made of a polyolefin, of which polyethylene is typically preferred.

To further stabilize and enhance the advantages of the present invention, the recording apparatus preferably further comprises, for example, a backup auxiliary means with respect to recording head 13. Specifically, a capping means or wiping means for recording head 13 is effective to stably make records.

The present invention can also be applied to a full-line type recording head having a length corresponding to the maximum width of recording media on which the recording apparatus can make recorded images. As such a full-line type recording head, a recording head unit comprising plural recording heads to satisfy the maximum width, or a single-piece recording head having fully-integrated individual parts can be employed.

The species and number of recording heads to be mounted on the recording apparatus are not specifically limited. For example, the recording apparatus may comprise only one recording head corresponding to a monochromatic ink or may comprise plural recording heads corresponding to plural inks having different recording colors or concentrations (densities). Specifically, the present invention can be very effectively applied not only to a recording apparatus having a recording mode for only one dominating color such as black but also to a recording apparatus having a recording mode of a multi-color comprising different colors or of a full color comprising a color mixture. In the latter case, the recording head may be composed of one integrated piece or of a combination of plural pieces.

Figure 10:
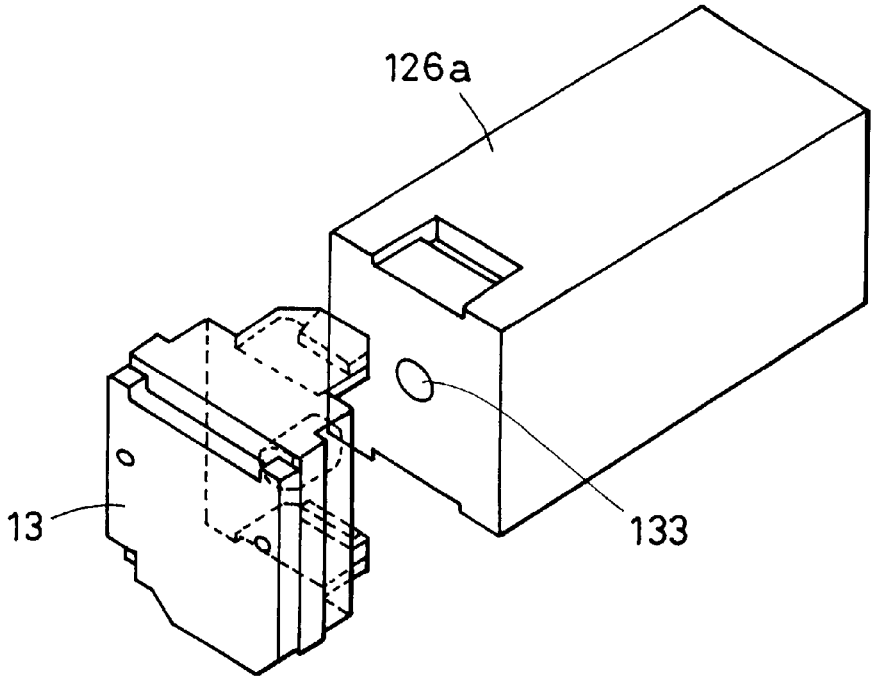
FIG. 10 is a perspective view showing the configuration of an example of a recording head and an ink cartridge of an ink-jet recording apparatus according to an embodiment of the present invention.
Figure 11:
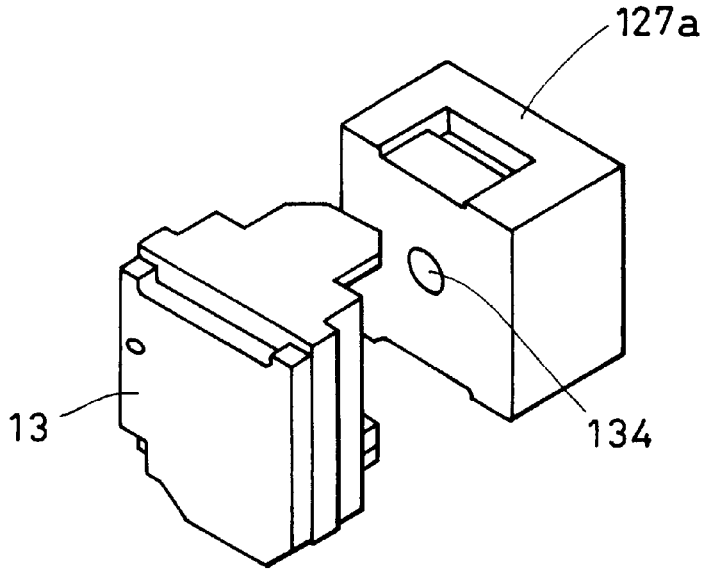
FIG. 11 is a perspective view showing the configuration of an example of a recording head and a liquid composition cartridge of an ink-jet recording apparatus according to an embodiment of the present invention.

In the invented ink-jet recorder, it is preferred that ink cartridge 126*a* and recording head 13 are detachably or removably configured according to necessity. An ink (not shown) in ink cartridge 126*a* should be preferably supplied to recording head 13 through ink supply opening 133 in a state where cartridge 126*a* is mounted on the recording head, as shown in FIG. 10. In this configuration, a user can clean the recording head when the ink cartridge is exchanged or when a printing concentration is decreased or an image is disturbed due to kogation even if the ink remains in ink cartridge 126*a*. Specifically, liquid composition cartridge 127 shown in FIG. 11 is mounted on recording head 13, and the liquid composition in liquid composition cartridge 127 is supplied through liquid composition supply opening 134 to recording head 13, and recording head 13 is allowed to discharge to thereby remove koga on the surface of the heater or to thereby clean the surface of the heater.

In this case, liquid composition cartridge 127 should preferably have a different shape or size from that of ink cartridge 126*a* to thereby distinguish the both cartridges. Alternatively, the liquid composition cartridge may include a mechanism or shape or an electric contact to allow the printer (recording apparatus) to distinguish the content in the cartridge as the liquid composition. In addition, the liquid composition preferably further comprises a small amount of a coloring material to ensure that the user can check whether discharge for removing koga is performed.

The present invention will be illustrated in further detail with reference to several invented examples and comparative examples below which are not intended to limit the scope of the invention. All parts and percentages are by weight unless otherwise specified.

EXAMPLES 1 TO 6

Individual components as indicated below were sufficiently mixed and were dissolved, and the resulting solutions were filtered under a pressure through a microfilter (manufactured by Fuji Photo Film Co., Ltd.) having a pore size of 0.2 $\mu$m to yield a series of liquid compositions (cleaning solutions) according to Examples 1 to 6, respectively.

Composition of Liquid Composition of Example 1

| | |
|---|---|
| sodium oxalate | 5 parts |
| diethylene glycol | 10 parts |
| water | 85 parts |

Composition of Liquid Composition of Example 2

| | |
|---|---|
| malic acid (DL-) | 5 parts |
| sodium hydroxide | 3 parts |
| diethylene glycol | 10 parts |
| water | 82 parts |

Composition of Liquid Composition of Example 3

| | |
|---|---|
| citric acid | 5 parts |
| sodium hydroxide | 3 parts |
| diethylene glycol | 10 parts |
| water | 82 parts |

Composition of Liquid Composition of Example 4

| | |
|---|---|
| sodium gluconate | 10 parts |
| diethylene glycol | 10 parts |
| water | 80 parts |

Composition of Liquid Composition of Example 5

| | |
|---|---|
| lithium tartrate monohydrate | 10 parts |
| diethylene glycol | 10 parts |
| water | 80 parts |

Composition of Liquid Composition of Example 6

| | |
|---|---|
| disodium β-glycerophosphate pentahydrate | 5 parts |
| diethylene glycol | 10 parts |
| water | 85 parts |

COMPARATIVE EXAMPLE 1

Individual components as indicated below were sufficiently mixed and were dissolved, and the resulting solution was filtered under a pressure through a microfilter (manufactured by Fuji Photo Film Co., Ltd.) having a pore size of 0.2 μm to yield a liquid composition according to Comparative Example 1.

Composition of Liquid Composition of Comparative Example 1

| | |
|---|---|
| diethylene glycol | 10 parts |
| water | 90 parts |

Preparation of Evaluative Ink A

Individual components as indicated below were sufficiently mixed and were dissolved, and the resulting solution was filtered under a pressure through a microfilter (manufactured by Fuji Photo Film Co., Ltd.) having a pore size of 0.2 μm to yield an evaluative ink A.

| [Composition of Evaluative Ink A] | |
|---|---|
| Project Fast Black 2 (produced by Zeneca) | 2.5 parts |
| glycerin | 5 parts |
| ethylene glycol | 10 parts |
| 2-propanol | 4 parts |
| sodium hydroxide | 0.1 part |
| water | 78.4 parts |

Evaluation

The liquid compositions according to Examples 1 to 6 and Comparative Example 1 were evaluated using the evaluative ink A. In this evaluation, an ink-jet recording apparatus including an on-demand multi-recording head (manufactured by CANON KABUSHIKI KAISHA under the trade name of "BC-02") was used at a driving pulse width of 1.1 μm, (On) +3.0 μs, (Off) +3.2 μs (On), at a driving voltage of 24.6 V, at a driving frequency of 6250 Hz. In the multi-recording head, an ink is discharged by applying thermal energy corresponding to recording signals to the ink, and an outermost protective layer on a heater is made of tantalum and tantalum oxide.

Initially, the evaluative ink A was continuously discharged using the ink-jet recording apparatus under the driving conditions mentioned above, and droplets discharged from the recording head were collected into a vessel every $1\times10^6$ shots (droplets), and were weighed with an electronic balance. An average of discharged droplets of $1\times10^6$ shots was calculated from an increased weight of the vessel. In this connection, the ink was continuously discharged until $1\times10^8$ shots of droplets were discharged.

As a result, the average of discharged droplets between $9.9\times10^7$ shots and $1\times10^8$ shots became about 70% of that between 0 and $1\times10^6$ shots.

The recording head was then disassembled, and the surface of a heater of a nozzle used for the discharge endurance test was subjected to visual observation using an optical microscope (magnification of 400 times) to find that there were a lot of adhered koga. After the discharge endurance test of $1\times10^8$ shots using the evaluative ink A, the recording head used in the test was filled with each of the above-prepared liquid compositions. Using the nozzle used in the discharge endurance test, each $5\times10^6$ shots of the liquid compositions according to Example 1 to 6 and Comparative Example 1 were discharged. Subsequently, the evaluative ink A was recharged, and the average discharge amount of $1\times10^6$ shots of droplets was determined. The recording head was then disassembled, and the surface of a heater of a nozzle used for the discharge endurance test was subjected to visual observation with an optical microscope (magnification of 400 times). The above results were evaluated according to the following criteria, and the evaluation results are shown in Table 1.

(1) Recovery of Discharge Amount

A: The average amount of discharged droplets after cleaning with the liquid composition was well recovered and was 90% or more that determined after 0 to $1\times10^6$ shots.

B: The average amount of discharged droplets after cleaning with the liquid composition was slightly recovered and was 70% to 90% of that determined after 0 to $1\times10^6$ shots.

C: The average amount of discharged droplets after cleaning with the liquid composition was not recovered and was 70% of that determined after 0 to $1\times10^6$ shots.

(2) Amount of Koga

A: Little koga was observed.

B: Slight koga was observed.

C: A large quantity of koga was observed.

TABLE 1

Evaluation Results

| | Cleaner | (1) Recovery of Discharge Amount | (2) Amount of Kogation |
|---|---|---|---|
| Example 1 | sodium oxalate | A | A |
| Example 2 | malic acid (DL-) | A | A |
| Example 3 | citric acid | A | A |
| Example 4 | sodium gluconate | A | A |
| Example 5 | lithium tartrate monohydrate | A | A |
| Example 6 | disodium β-glycero-phosphate pentahydrate | A | A |
| Comp. Ex. 1 | none | C | C |

As is described above, the present invention can clean and remove koga on a heater formed after long-term use of an ink-jet recording head, or contaminants introduced during manufacture of the ink-jet recording head, without significant damage onto the heater, and can further prolong the life of the recording head.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid composition for cleaning a surface of a heater or a surface of a protective layer on the heater of a thermal ink-jet head by applying energy thereto with the heater, comprising an aqueous medium and a compound in an effective amount to clean the surface of the heater or the surface of the protective layer, wherein the compound is at least one selected from the group consisting of a carboxylic acid, a salt of the carboxylic acid, an ester of the carboxylic acid, a salt of the ester of the carboxylic acid, a polyol phosphoric acid, a salt of the polyol phosphoric acid, an ester of the polyol phosphoric acid, and a salt of the ester of the polyol phosphoric acid.

2. A liquid composition according to claim 1, wherein said protective layer comprises at least one selected from the group consisting of metals and metal oxides.

3. A liquid composition according to claim 2, wherein said metal is tantalum.

4. A liquid composition according to claim 1, wherein said carboxylic acid has a hydroxyl group.

5. A liquid composition according to claim 1, wherein the carboxylic acid is an aldonic acid or an aldaric acid.

6. A liquid composition according to claim 1, wherein the ester of a carboxylic acid is at least one of γ-aldonic lactone and δ-aldonic lactone.

7. A liquid composition according to claim 1, wherein said salt is one selected from the group consisting of a lithium salt, a sodium salt, and a potassium salt.

8. A liquid composition according to claim 1, wherein said polyol phosphoric acid is at least one of α-glycerophosphoric acid and β-glycerophosphoric acid.

9. A liquid composition for use in removal of adherents adhered on a surface of a protective layer covering a heater of an ink-jet recording head for discharging an ink containing a coloring material by action of said heater, the protective layer comprising at least one of a metal and a metallic oxide, wherein said liquid composition oxidatively decomposes adherents on the surface of the protective layer by applying energy to said heater in a state where said protective layer is in contact with said liquid composition.

10. A liquid composition according to claim 9, comprising at least one selected from the group consisting of an organic acid, a salt of organic acid, an organic acid ester, and a salt of organic acid ester.

11. A process for cleaning a surface of a protective layer covering a heater of an ink-jet recording head, the protective layer comprising at least one of a metal and a metallic oxide, said process comprising a step of applying energy to said heater in a state where said protective layer is in contact with a liquid composition, wherein the liquid composition comprises an aqueous medium and a compound which is at least one selected from the group consisting of an organic acid, a salt thereof, an ester thereof, and a salt of the ester, in an effective amount to clean the surface of the protective layer.

12. An ink-jet recording apparatus comprising:

an ink tank filled with an ink containing a coloring material;

an ink-jet recording head provided with a heater for discharging said ink;

a liquid tank filled with the liquid composition comprising an aqueous medium and a compound which is at least one selected from the group consisting of an organic acid, a salt thereof, an ester thereof, and a salt of the ester in an effective amount to clean a surface of the heater;

a supply path for supplying said liquid composition and said ink respectively from said liquid tank and said ink tank to said ink-jet recording head; and a valve mechanism for optionally selecting between the supply of said liquid composition and the supply of said ink to said recording head.

13. An ink-jet recording apparatus comprising:

an ink tank filled with an ink containing a coloring material;

an ink-jet recording head provided with a heater whose surface is covered with a protective layer comprising at least one of a metal and a metallic oxide;

a liquid tank filled with a liquid composition comprising an aqueous medium and a compound which is at least one selected from the group consisting of an organic acid, a salt thereof, an ester thereof, and a salt of the ester, in an effective amount to clean a surface of the protective layer;

a supply path for supplying said liquid composition and said ink respectively from said liquid tank and said ink tank to said ink-jet recording head; and a valve mechanism for optionally selecting between the supply of said liquid composition and the supply of said ink to said recording head.

14. An ink-jet recording apparatus according to claim 13, wherein said metal is tantalum.

15. A cartridge for use in cleaning of a surface of a heater or a surface of a protective layer covering a surface of a heater of an ink-jet recording head, the protective layer comprising at least one of a metal and a metal oxide, wherein said cartridge is detachably configured with respect to said ink-jet recording head and stores the liquid composition of claim 1.

16. A process for regenerating an ink-jet recording head, said ink-jet recording head having a heater and serving to discharge an ink containing a coloring material, a surface of said heater being covered with an protective layer comprising at least one of a metal and a metallic oxide, said process comprising the step of applying thermal energy to said heater in a state where the surface of said protective layer is in contact with a liquid composition, wherein the liquid composition comprises an aqueous medium and a compound which is at least one selected from the group consisting of an organic acid, a salt thereof, an ester thereof, and a salt of the ester, in an effective amount to clean a surface of the protective layer.

* * * * *